United States Patent [19]

Duncan et al.

[11] 3,953,262

[45] Apr. 27, 1976

[54] MONOPROPELLANT COMPOSITION COMPRISING HYDRAZINE AND METHOXYLAMINE NITRATE

[75] Inventors: William A. Duncan; James A. Murfree, Jr.; Pasquale Martignoni; Walter W. Wharton, all of Huntsville; John F. Phillips, Florence, all of Ala.

[73] Assignee: The United States of America as represented by the Secretary of the Army, Washington, D.C.

[22] Filed: Nov. 20, 1969

[21] Appl. No.: 886,597

[52] U.S. Cl. ..... 149/36; 149/92

[51] Int. Cl.[2] ..... C06B 25/34; C06B 43/00; C06B 47/08

[58] Field of Search ..... 149/36, 92; 260/501.17; 60/218

[56] References Cited

UNITED STATES PATENTS

| | | | |
|---|---|---|---|
| 2,943,927 | 7/1960 | Audrieth et al. | 149/36 |
| 3,117,415 | 1/1964 | Greene | 149/36 X |
| 3,171,249 | 3/1965 | Bell | 149/36 X |
| 3,503,212 | 3/1970 | Jennings et al. | 60/219 |

*Primary Examiner*—Edward A. Miller

*Attorney, Agent, or Firm*—Nathan Edelberg; Robert P. Gibson; James T. Deaton

[57] ABSTRACT

The use of methoxylamine nitrate ($CH_3ONH_2.NHO_3$) as an additive to exothermally decomposing liquid monopropellants such as hydrazine and hydrazine water mixtures to lower the freezing points of the monopropellants and thereby render the monopropellants usable in gas generators at very low temperatures.

6 Claims, No Drawings

MONOPROPELLANT COMPOSITION COMPRISING HYDRAZINE AND METHOXYLAMINE NITRATE

CROSS REFERENCE TO RELATED APPLICATIONS

This application is related to copending applications Ser. No. 863,757, filed Oct. 1, 1969, Ser. No. 863,758 filed Oct. 1 1969, now U.S. Pat. No. 3,711,427 and Ser. No. 651,654 filed July 5, 1967, now U.S. Pat. No. 3,757,520.

BACKGROUND OF THE INVENTION

In the past, the use of liquid monopropellants in gas generators has been limited due to the freezing points of the liquid monopropellants used. It is very desirable to have an energetic liquid monopropellant composition that can be used in a gas generator at very low temperatures as well as at high temperatures. This would render the gas generator operable in practically any atmospheric temperature environment.

Therefore, it is an object of this invention to provide novel liquid monopropellant compositions.

Another object of this invention is to provide liquid monopropellant compositions that have freezing points that can be extended below −52°C.

A further object of this invention is to provide a liquid monopropellant composition that has a low freezing point, yet the specific impulse of the liquid monopropellant is still sufficient for good gas generator operation.

SUMMARY OF THE INVENTION

It has been discovered that methoxylamine nitrate ($CH_3ONH_2.HNO_3$) when used as an additive to hydrazine, to a hydrazine water mixture or to other exothermally decomposing monopropellants produces a liquid monopropellant composition that has a freezing point that can be extended below −52°C. The liquid monopropellant composition produced has good exothermic decomposition properties when used with gas generator initiators (see copending application Ser. No. 651,654) such as $HIO_3$ and $KMnO_4$ and gas generator catalysts.

DESCRIPTION OF THE PREFERRED EMBODIMENTS

This invention concerns the use of methoxylamine nitrate ($CH_3ONH_2.HNO_3$) as an additive to hydrazine, to a hydrazine water mixture and to hydrazine like monopropellants to lower the freezing point of the monopropellant or hydrazine. A concentration of 40 weight per cent methoxylamine nitrate in 60 weight percent hydrazine lowers the freezing point of the hydrazine from its normal value of +1°C to −52°C. This freezing point is adequate for practically all environmental temperatures. The viscosity of a 34 weight percent solution at 21°C is 2.56 centistokes while at −35°C, it is 24 centistokes. These viscosities are acceptable for the intended uses.

Since nitrate compositions greater than 25 weight percent are considered to be dangerously explosive in many gas generator applications, it was decided to stay below the explosive range and maintain a constant composition of 20 weight per cent methoxylamine nitrate, to vary the water composition from about 0 to about 20 weight per cent, and with the remainder being hydrazine. The freezing points of the resultant mixtures were measured to determine a partial binary phase diagram of the ternary system. This partial phase diagram was obtained and indicated that a mixture of 68 weight per cent hydrazine, 20 weight per cent methoxylamine nitrate, and 12 weight per cent water has a freezing point of approximately −60°C. For further verification, a one milliliter sample of this monopropellant composition was stored for 2 weeks at −50°C to −53°C, with frequent stirring, vibrations, and seeding. No solid was observed and the test was terminated.

The monopropellant composition of 68 weight per cent hydrazine, 20 weight per cent methoxylamine nitrate and 12 weight per cent water is very promising. Several of the physical and chemical properties of this composition have been investigated including:

1. Theoretical Calculations: Assuming equilibrium composition during expansion from 1,000 to 14.7 PSI, the Lewis computer program indicates a flame temperature of 1108°K, specific impulse of 198 sec., C* of 4126 ft/sec., and decomposition products having an average molecular weight of 14.3.

2. Density: The density of this monopropellant ranges from 1.09 grams/milliliter at 25°C to 1.13 grams/milliliter at −40°C.

3. Viscosity: The viscosity of the monopropellant ranges from 2.2 centistokes at 25°C to 23 centistokes at −40°C.

4. Thermal Stability: The monopropellant was run on a Dupont Differential Thermal Analysis instrument from −196°C to the boiling point of hydrazine (113°C) at a rate of 15°C per minute. The thermogram only showed the phase transitions and did not indicate any exothermic decomposition over the specified temperature range.

5. Reactivity with Initiators and Catalysts: Spot plate tests show that the monopropellant is extremely reactive with common gas generator initiators, e.g. $HIO_3$ and $KMnO_4$ (see copending application Ser. No. 651,654). Further tests show that the monopropellant is also very active with good gas generator catalysts. Tests were run with the Shell 405 Catalyst and with the catalysts of manganese and molybdenum. The manganese and molybdenum catalysts are disclosed in copending applications Ser. Nos. 863,757 and 863,758. The catalysts and initiators when used in gas generators are usually mounted in inert porous material such as insulating porous firebrick or porous ceramic.

The methoxylamine nitrate-hydrazine mixture is believed to be an unknown mixture of hydrazinium ion ($NH_2NH_3+$), methoxylammonium ion ($CH_3ONH_3+$) and nitrate ion ($NO_3-$). Consequently, the mode of compounding the fuel is not critical. While the fuel mixtures tested were made by adding methoxylamine nitrate to hydrazine, the same result may be obtained by adding nitric acid to a hydrazine-methoxylamine mixture. When water is used, the hydrazine and water are combined before the methoxylamine nitrate is added to the solution.

We claim:

1. A liquid monopropellant composition of matter adapted for a liquid type gas generator that has a thermal initiator bed to produce gas when said liquid monopropellant is brought into contact with said bed, said liquid monopropellant composition comprising a solution of hydrazine and methoxylamine nitrate, said methoxylamine nitrate being present in an amount of from about 0.5 to about 40 weight per cent of said solution.

2. The composition of matter of claim 1 wherein said methoxylamine nitrate is present in an amount of about 10 to about 25 weight per cent.

3. The composition of matter of claim 1 wherein said solution further comprises water in an amount up to about 20 weight per cent, said methoxylamine nitrate is present in an amount of about 5 to about 35 weight per cent and the remainder of said solution is hydrazine.

4. The composition of matter of claim 1 wherein said solution further comprises water in an amount of about 12 weight per cent, said methoxylamine nitrate is present in an amount of about 20 weight per and said hydrazine is present in an amount of about 68 weight per cent.

5. The composition of matter of claim 1 wherein said solution further comprises water in an amount up to about 20 weight per cent, said methoxylamine nitrate is present in an amount of about 0.5 to about 25 weight per cent and the remainder of said solution is said hydrazine.

6. The composition of matter of claim 1 wherein said solution consists of about 40 weight per cent of said methoxylamine nitrate and about 60 weight per cent of said hydrazine.

* * * * *